US005505452A

United States Patent [19]

Meaden

[11] Patent Number: 5,505,452

[45] Date of Patent: Apr. 9, 1996

[54] HYBRID GOLF GAME

[76] Inventor: Charles E. Meaden, 103 E. Hamilton Ave., Englewood, N.J. 07631

[21] Appl. No.: 19,318

[22] Filed: Feb. 18, 1993

[51] Int. Cl.[6] ..... A63B 69/36

[52] U.S. Cl. ..... 273/182 A; 273/35 R; 273/181 H; 273/213; 273/58 R

[58] Field of Search ..... 273/176, 182, 273/14, 32 R, 34 R, 62, 177 R, 213, 178 R, 179, 180, 181, 178, 187.3, 35 B, 183.1, 389, 394, 396, 397, 398, 113, 125

[56] References Cited

U.S. PATENT DOCUMENTS 3,708,173 1/1973 Hewson, Jr. ..... 273/176 A
3,990,708 11/1976 Ingwersen ..... 273/176 A

*Primary Examiner*—Vincent Millin

*Attorney, Agent, or Firm*—Richard A. Joel

[57] ABSTRACT

Hybrid golf comprises playing a variety of golf shots around a progressive course comprising a single centrally located hole with a green. A plurality of tees are located at different predetermined distances from the green and at spaced intervals from each other in a substantially circular pattern around the green. Bar coded golf balls are used for scoring purposes in conjunction with a bar code optical or other type of scanner reader mounted on each tee and within the hole. All scoring information is recorded by a central computer in order to facilitate immediate comparison of scoring data of a single player or between and among players. At least one putting green is located adjacent the last tee. A player drives the ball from successive tees and then putts on the putting green to wrap up the game. The object of the game is to put as many of the six bar coded balls as possible on the green, and thereby automatically through the scanner.

6 Claims, 2 Drawing Sheets

HYBRID GOLF GAME

BACKGROUND OF THE INVENTION

Golf courses require a considerable amount of space in order to lay out the course and it requires a great deal of time in order to play the game of golf. As a consequence of the space and time required, golf has become an increasingly expensive and inaccessible game; especially in urban and suburban areas where golfers often are unable to gain access to courses at reasonable rates and during reasonable hours of play. The present invention is designed to provide an accessible, less time consuming, more economical and exciting alternative to conventional golf by providing a hybrid game which will test conventional golf shot making skills but be played on a dramatically different course.

A ready means of computer scoring the game through the use of bar coded golf balls is also included and the accuracy and immediacy of scoring will lead to excitement with scoring and record-keeping options unavailable in conventional golf. A plurality of tees are located about a single golf green and hole and the ball is driven from the tees in succession. The player advances from one tea to another hitting the ball different distances each time. One or more putting greens are provided so that the player can include a putting game a long with progressive shot making.

None of the prior art patents disclose computer scoring via scanner record-keeping or timing of the shot-making in order to keep the game fast paced.

The prior art includes U.S. Pat. No. 4,192,511 to Fitzgerald which discloses a Portable Miniature Golf Game with a circular central fairway. The game is not a full size version of golf nor does it provide for computer scoring and record-keeping and all of the holes are uniform but it does disclose the concept of the central point for all holes.

U.S. Pat. No. 4,129,300 to Magnuson discloses a compact golf course comprising a set of playing areas surrounding a set of elongated target fairway areas disposed at an angle to each other.

Another patent of interest is U.S. Pat. No. 3,685,832 to Johnson which relates to a Method of Playing a Golf Game which includes approach greens on a forward fairway, consecutively numbered teeing positions and a rearward putting area, all of which require more space than the present invention and none of which disclose the concept of a central green with computer scoring and recording through the use of scanners on both the tees and the green.

Other patents of interest include U.S. Pat. No. 3,876,210 to Brandell on a golf putting device and U.S. Pat. No. 4,660,039 to Barricks which discloses a locating system for sports object wherein the user carries an r.f. transmitter and the sport object or ball has a conductive stripe thereon.

SUMMARY OF THE INVENTION

This invention relates to a golf type game and more particularly to a Hybrid Golf Game which includes a plurality of teeing positions located at spaced intervals about a single green and at varying distances therefrom. A bar code scanner computer reader is mounted within the hole and bar coded golf balls are provided in order to facilitate scoring. A bar code scanner is also placed on the tee in order to facilitate scoring, record-keeping and timing of the shot-making during the course of the game. Putting greens are positioned adjacent the teeing positions so that a player can putt after completing his shot-making from the successive tees by driving the golf ball to the central hole.

More specifically, this invention relates to a golf type game and particularly to a Hybrid Golf Game which requires less space and may be played in a shorter time period and at a lower cost than a conventional golf game.

The Hybrid Golf Game comprises a plurality of tees each located at a predetermined distance from a central green with a hole. The tees are located on an elevated platform each of which is spaced a predetermined distance from an adjacent tee. Each tee will have a bar code scanner which a player will activate before driving onto a hole with one of six bar coded balls. The distances from the various tees to the hole range from approximately one hundred yards to two hundred and fifty yards. The green comprises a funnel type configuration where a hole having a bar code reader is located at the bottom of the funnel so that the bar coded golf balls used by the players drop in and can be readily scored. One or more putting greens are located adjacent the last tee so that the players will be required to putt as well as make other shots to complete the game for a score.

In playing the game, a player would drive a golf ball from a tee to a single centrally located hole with one green. In the illustrated embodiment, six numbered tees from which the players hit the ball to the single central green are depicted. After driving on the six tees, a player would then proceed to the putting green to finish his game. Scoring on tees 1–6 would be on a "0" or "1" basis with the player hitting the green on any "hole" awarded a "0" and those off the mark would be assigned a "1". Placement on the putting green would depend on one's score or on the last "hole" with the player scoring a "0" awarded a 15 foot shot and those scoring "1" a marked 30 foot putt.

Accordingly, an object of this invention is to provide a new and improved hybrid golf game.

Another object of this invention is to provide a new improved hybrid golf game which requires substantially less space than a conventional golf course and the game may be played in a relatively short interval of time.

Another object of this invention is to provide a new and improved hybrid golf game including automatic scoring and record-keeping utilizing bar coded balls and a computer bar code scanner.

A still further object of this invention is to provide a new and improved hybrid golf game having a single green with a hole located thereon and a plurality of tees surrounding the hole at different predetermined distances.

A more specific object of this invention is to provide a new and improved hybrid golf game wherein a single green with a hole having a bar code reader mounted therein is surrounded by a plurality of spaced tees also equipped with bar code scanner at different predetermined distances wherein bar coded golf balls are driven onto the green from the various tees in succession and the game is culminated by putting on adjacent greens. In order to keep the play of the game moving and also to facilitate computer record-keeping and scoring the player would log-onto each tee by passing his bar coded ball on that particular hole over a scanner; after logging on he would have 3 minutes to make his shot from that hole.

DESCRIPTION OF THE DRAWINGS

The foregoing and other objects and advantages of the invention may be more clearly seen when viewed in conjunction with the accompanying drawings wherein.

DETAILED DESCRIPTION OF THE INVENTION

Figure 1:
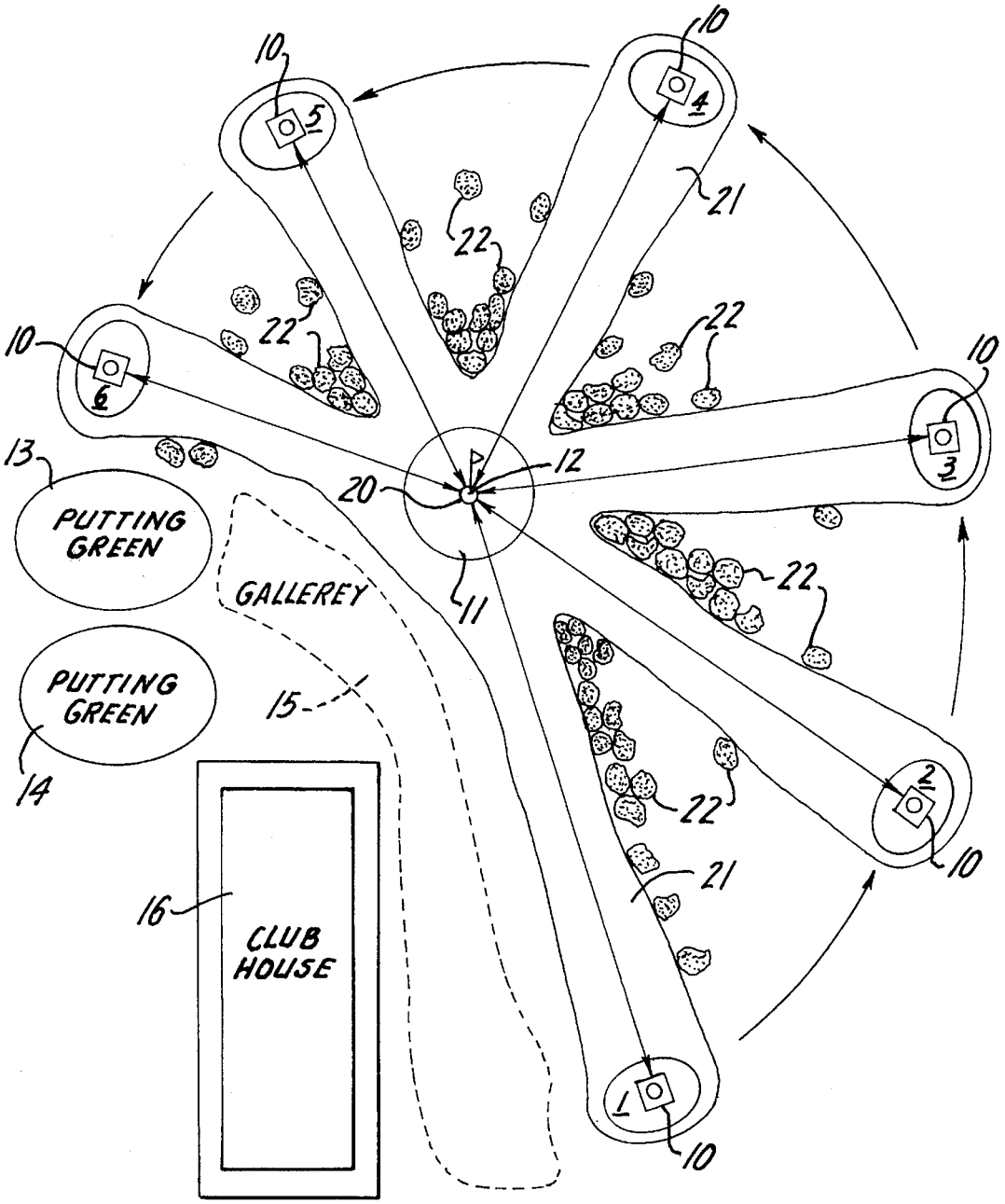
FIG. 1 is a plan view of the layout of the hybrid golf course for playing the game disclosed herein.
Figure 2:
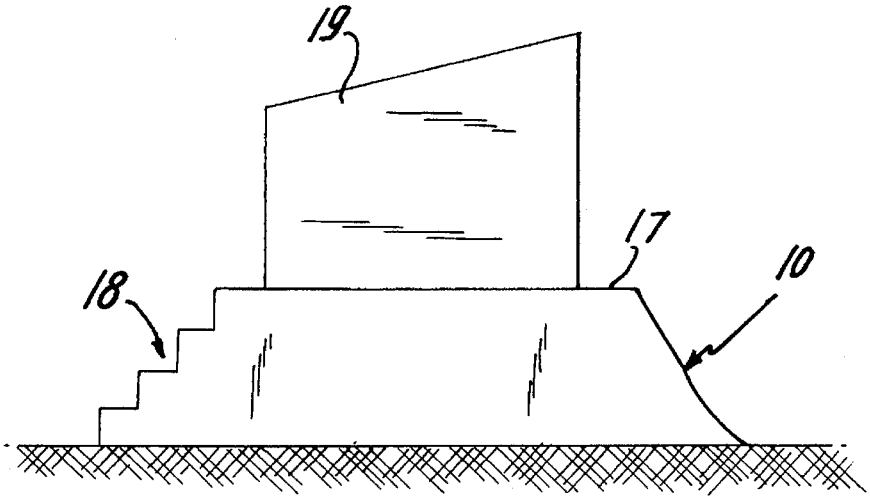
FIG. 2 comprises a side view of a typical tee in this Hybrid Golf Game.

Referring now to the drawings the invention comprises a Hybrid Golf Game wherein a plurality of tees labeled one through six are located about a green 11 having a hole 12 positioned thereon. The tees 10 are at varying distances from the hole 12 and in a typical example tees one through six are shown at distances of two hundred fifty yards, one hundred eighty yards, one hundred sixty yards, one hundred forty yards, one hundred twenty yards and one hundred yards respectively. Putting greens 13 and 14 are located adjacent the last tee labeled six. Space is provided for a gallery 15 and a clubhouse 16 to simulate a typical golf course.

A typical tee 10 is located on an elevated platform 17 with steps 18 leading to the platform 17 a protective shed 19 and a bar code scanner for logging on and shot timing with optional seating is provided for the golfers.

Figure 3:
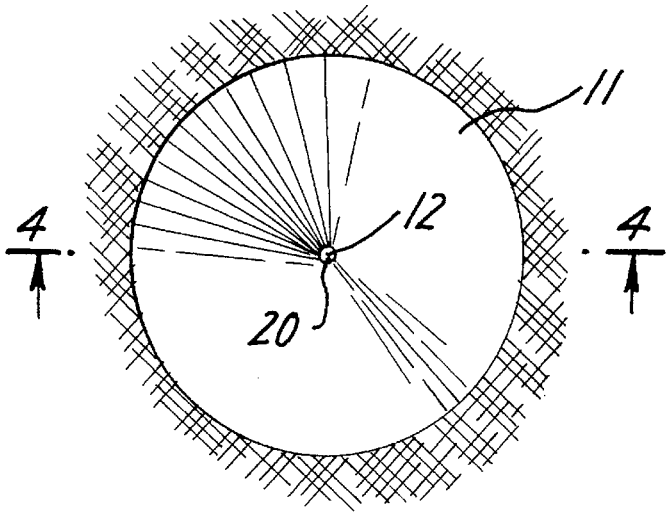
FIG. 3 comprises a plan view of a typical green.
Figure 4:
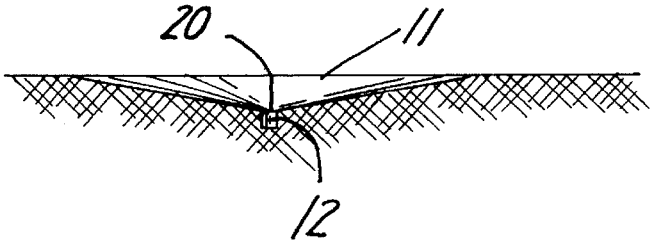
FIG. 4 comprises a cross-sectional view of the green taken along the line 4—4 of FIG. 3.

FIGS. 3 and 4 depict the single green 11 which is approximately twenty yards across and is funnel shaped. A bar code reader 20 is mounted in the hole to read the score on bar coded golf balls which are used in the game. A flag 21 is used to mark the hole but is positioned so not to interfere with the balls rolling into the hole. The game involves a variety of golf shots involving typical skills employed in playing a typical golf game but the layout of the course requires a fraction of the space utilized by a typical course. Also, it is possible to play the game much faster than a typical golf game and according to the rules a limited time would be allowed for shot-making on each hole. It is estimated that the game could be completed in less than one hour whereas even nine holes of golf could require two to three hours time.

In playing the game a player hits his bar coded ball from the tees labeled 1 through 6 in succession onto the green 11. Player log-on is accomplished by passing their ball for log-on over a scanner. They then have three minutes which is automatically timed in order to complete their shot from that hole. The complete scoring system will now score the player's ball for them. After the three minutes have elapsed and the player has not taken his shot, he can choose to restart the timer by passing the ball over the tee scanner. The players are grouped into parties of four and drive in sequence from a particular tee 10. Scoring on holes 1–6 would be either "0" or "1" with the players who hit the green on a hole awarded a "0" and those off the mark assigned a "1". Consequently, a player could have a low score of "0" for holes 1–6 or a high score of "6". The game is finished on the putting green 13.

Those players who scored a "0" on hole number six would be assigned a fifteen foot putt to hole out and complete a round whereas those who had scored "1" on hole number six would be putting from thirty feet. A tied score would be settled by playing a second sudden death round until a player loses a hole or, at the player's option, by a putt from forty five feet on the green 13 where the player closest to the hole would win.

In summary, the bar coded golf balls would register "hits or misses" on a computer scoreboard screen so that the players would not have to approach the hole computer scoreboard to find out if their ball had landed on the green. A running total of their score would be provided at each hole so that a player could determine where he stood in the match. The hybrid golf game gives a player an opportunity to use different clubs since the distances vary from one hundred yards to two hundred and fifty yards at the different tees 10. While the game utilizes golf equipment and various themes from a conventional golf game. The game itself is unique, fast and interesting. Since less space is required and the play is fast paced and controlled by computer timing, scoring and record-keeping the hybrid golf game should be a profitable enterprise.

While the invention has been explained by a detailed description of certain specific embodiments, it is understood that various modifications and substitutions can be made in any of them within the scope of the appended claims which are intended also to include equivalents of such embodiments.

What is claimed is:

1. A hybrid golf game having a plurality of driving tees and golf balls which are driven to a hole from the tee by a player comprising:

a single green having a single hole located thereon and a bar code scanner mounted within said hole, a plurality of driving tees positioned about the green at varying spaced intervals and distances therefrom, each having a bar code scanner thereon for logging on a particular ball, a golf ball having bar code designations thereon which is driven from a tee to the hole, and scoring means mounted within the hole comprising a bar code scanner which records scores for each particular ball.

2. A hybrid golf game in accordance with claim 1 wherein:

the golf green is funnel shaped so that bar coded balls landing on the green roll into the hole so that the score is recorded.

3. A hybrid golf game in accordance with claim 2 wherein:

the driving tees comprise six elevated platofrms each having a scoring means with a scanner located thereon for log-on of the ball before driving and setting predetermined time interval for driving.

4. A hybrid golf game in accordance with claim 2 wherein:

the scoring means is set to record a "0" when a player's ball hits the green and rolls into the hole and a "1" if the ball does not land on the green and rolls into the hole.

5. A hybrid golf game in accordance with claim 2 further including:

a putting green located adjacent the driving tees so a player may putt for scoring purposes after driving his ball from the tee.

6. The method of playing a hybrid golf game comprising the steps of:

providing a plurality of driving tees located at varying predetermined distances from a single hole, providing a scoring scanner on each of a plurality of driving tees, logging-on a bar coded golf ball by passing it before a scanner on a tee, driving the ball from a tee towards a funnel shaped green with a central hole, providing a scoring scanner in the hole to record balls which land on the green and provide a score, putting the ball on an adjacent green from a distance determined by whether the previous drive landed on the green, and, moving to the next tee to drive a ball to the hole after log-on.

* * * * *